US005317981A

United States Patent [19]

Hashiride et al.

[11] Patent Number: 5,317,981

[45] Date of Patent: Jun. 7, 1994

[54] PROGRAMMED PRESSURE FOOT POSITIONING FOR CONTROL MEANS SEWING MACHINE

[75] Inventors: Tadaaki Hashiride, Okazaki; Masahiro Sahashi, Kariya, both of Japan

[73] Assignee: Aisin Seiki Kabushiki Kaisha, Kariya, Japan

[21] Appl. No.: 73,470

[22] Filed: Jun. 9, 1993

[30] Foreign Application Priority Data

Jun. 10, 1992 [JP] Japan ..... 4-150897

[51] Int. Cl.[5] ..... D05B 19/00; D05B 29/02

[52] U.S. Cl. ..... 112/121.11

[58] Field of Search ..... 112/121.11, 235, 237, 112/239, 240, 150, 151, 60, 61

[56] References Cited

U.S. PATENT DOCUMENTS

| | | | |
|---|---|---|---|
| 1,147,960 | 7/1915 | Mathewson | 112/235 |
| 1,221,291 | 4/1917 | Cornely | 112/235 X |
| 4,676,179 | 6/1987 | Nomura et al. | 112/239 |
| 5,080,031 | 1/1992 | Suzuki et al. | 112/237 X |

FOREIGN PATENT DOCUMENTS

| | | | |
|---|---|---|---|
| 291362 | 6/1991 | German Democratic Rep. | 112/235 |

*Primary Examiner*—Peter Nerbun

*Attorney, Agent, or Firm*—Sughrue, Mion, Zinn, Macpeak & Seas

[57] ABSTRACT

A sound of percussion or impact which is produced as a result of a vertical movement of a pressure foot driven in synchronism with a vertical movement of a sewing needle is eliminated. A sphere 15 exposed through the lower surface of a pressure foot 10 as well as a coiled compression spring 16 which urges the sphere are provided, so that the resilience of the spring is effective to suppress a vertical movement of the fabric while allowing a movement of a fabric 9 in a horizontal plane, thus eliminating the need for a vertical movement of the pressure foot as the needle is driven up and down. Alternatively, an independent drive source may be provided to move the pressure foot in synchronism with the vertical motion of the needle through a minimized stroke.

3 Claims, 10 Drawing Sheets

PROGRAMMED PRESSURE FOOT POSITIONING FOR CONTROL MEANS SEWING MACHINE

BACKGROUND OF THE INVENTION

The invention relates to a pressure foot unit for a sewing machine, in particular, a pressure foot unit which is specially adapted for use with an embroidery sewing machine.

Generally in a sewing machine, the shaft (needle bar) of a sewing needle is connected to an upper shaft which is driven for rotation through a cam or the like, and the sewing needle repeats its elevating motion in synchronism with the rotation of the upper shaft. When the sewing needle is raised to be withdrawn from a fabric, the fabric tends to be lifted by being pulled by the upper thread, thereby disturbing the thread tension. In order to prevent this, it is necessary to hold the fabric in position. In particular, a sewing operation of an embroidery sewing machine takes place while moving the fabric in diverse directions, and accordingly there is a high need to suppress the movement of the fabric during the passage of the needle. For this reason, a pressure foot in the form of a plate is disposed adjacent to the sewing needle of a sewing machine. However, it is necessary to unlock the pressure foot when moving the cloth or fabric, and hence the plate serving as a pressure foot is connected with the needle bar, and repeatedly undergoes an up and down movement through a relatively increased stroke as the sewing needle is being elevated. Hence, when the rotational speed of the upper shaft is increased to accelerate the elevating motion of the sewing needle, sounds are produced by percussion or impact as the pressure foot is being elevated.

A prior art for a pressure foot mechanism of a general sewing machine can be known from U.S. Pat. No. 4,981,094 (Class 235), for example.

SUMMARY OF THE INVENTION

Accordingly, it is an object of the invention to provide a pressure foot unit which is capable of providing a reliable pressure foot action while allowing a movement of a fabric in any desired direction within a horizontal plane by releasing such action as required and while suppressing the generation of sounds during the operation.

The object is accomplished in accordance with the invention by providing a pressure foot unit for a sewing machine, comprising a pressure foot member (10) disposed adjacent to a sewing needle (1) and elevatably supported by the body of the sewing machine; a plurality of spherical members (15A–15D) rotatably mounted at different positions within the pressure foot member and each disposed partly exposed through the lower surface of the pressure foot member; and elastic members (16A–16D) mounted on the pressure foot member for urging each spherical member downward.

According to another feature of the invention, the pressure foot unit further comprises drive means (20) for driving the pressure foot member for elevating motion; reference position detecting means (30) for detecting the pressure foot member located at a given position; and positioning control means (40) for energizing the drive means to position the pressure foot member as referenced to a position detected by the detecting means, to position the pressure foot member at a first position (P1) during the elevating motion of the sewing needle and during the movement of a fabric, and to position the pressure foot member at a second position (P2) higher than the first position in response to a given release command.

According to a further feature of the invention, the pressure foot unit further comprises drive means (20) for driving the pressure foot member for elevating motion; reference position detecting means (30) for detecting the pressure foot member located at a given position; and positioning control means (40) for energizing the drive means to position the pressure foot member as referenced to a position detected by the detecting means, to position the pressure foot member at a first position (P1) during the elevating motion of the sewing needle, to position the pressure foot member at a third position (P3) higher than the first position by an amount which is substantially on the order of the thickness of the fabric during the movement of the fabric, and to position the pressure foot member at a second position (P2) higher than the third position in response to a given release command.

According to an additional feature of the invention, the positioning control means includes position presetting means (50) which adjust each of the first, the second and the third position.

It is to be understood that numerals or characters appearing in parentheses refer to reference numerals used to designate elements shown in an embodiment to be described later, but that the elements used to practise the invention are not limited to specific form or construction of elements shown in the embodiment.

According to the invention, it is unnecessary to connect the pressure foot member with an elevating mechanism for a sewing needle mechanically, but may be positioned by driving it with independent drive means. A plurality of spherical members are rotatably disposed within the pressure foot member so as to be exposed through the lower surface of the member. These spherical members are urged downward by elastic members, so that when the pressure foot member is located at a pressed position (P1) and the spherical members urge the fabric downward, the fabric is permitted to move in a horizontal direction inasmuch as these spherical members are rotatable. Thus, during the operation of the sewing machine, the pressure foot member assumes its pressed position to press against the fabric while allowing its movement in a horizontal direction. Hence, the need to move the pressure foot member up and down as the sewing needle is elevated is eliminated, thus removing the occurrence of sounds by percussion or impact.

In accordance with another feature of the invention, the positioning control means which positions the pressure foot member operates to position the pressure foot member at a first position (pressed position) during the elevating motion of the sewing needle and during the movement of the fabric, and to position the pressure foot member at a second position (retracted position) higher than the first position in response to a given release command. Accordingly, when the pressure foot member is located at the first position, the fabric may be held in place against movement in vertical direction. However, in response to a given release command, the pressure foot member is raised to its retracted position, whereupon the engagement or disengagement of an embroidery frame or fabric can be easily implemented.

In accordance with a further feature of the invention, the positioning control means which positions the pressure foot member operates to position the pressure foot member at a first position during the elevating motion of the sewing needle, to position the pressure foot member at a third position higher than the first position during the movement of the fabric, and to position the pressure foot member at a second position higher than the third position in response to a given release command. Specifically, when the pressure foot member is located at its first position, the fabric can be held against movement, while when the pressure foot member is located at its third position where it is disposed above the first position by an amount which corresponds to the order of thickness of the fabric, any constraint exerted upon the fabric is released, allowing the fabric to be freely moved in a horizontal direction. When the pressure foot member is located at its third position, a clearance between the lower surface thereof and the fabric is very small, which is insufficient to allow the engagement or disengagement of an embroidery frame, and which is also unsuitable to perform the engagement or disengagement of the fabric alone. However, the pressure foot member may be raised to its second position by applying a given release command, whereupon the engagement or disengagement of an embroidery frame or fabric can be easily implemented. During the operation of the sewing machine, the pressure foot member repeatedly moves back and forth between the first and the third position, allowing a movement of the fabric when it is located at its third position. Since a distance between the first and the third position is relatively small, the stroke travelled by the pressure foot member during such reciprocating motion is reduced and does not require a high speed movement, thus suppressing the generation of sounds of percussion or impact caused by such movement.

In accordance with an additional feature of the invention, position presetting means may be used, and each of the first, the second and the third position may be adjusted. Accordingly, the first position may be adjusted to provide an optimum pressing force in accordance with the thickness of a fabric. The third position may be adjusted in accordance with the thickness of the fabric so that the pressing force is positively released at the second position while minimizing the stroke travelled by the pressure foot member. The second position may be adjusted in accordance with the height of an embroidery frame so as to facilitate its engagement and disengagement.

DETAILED DESCRIPTION OF PREFERRED EMBODIMENTS

Figure 1:
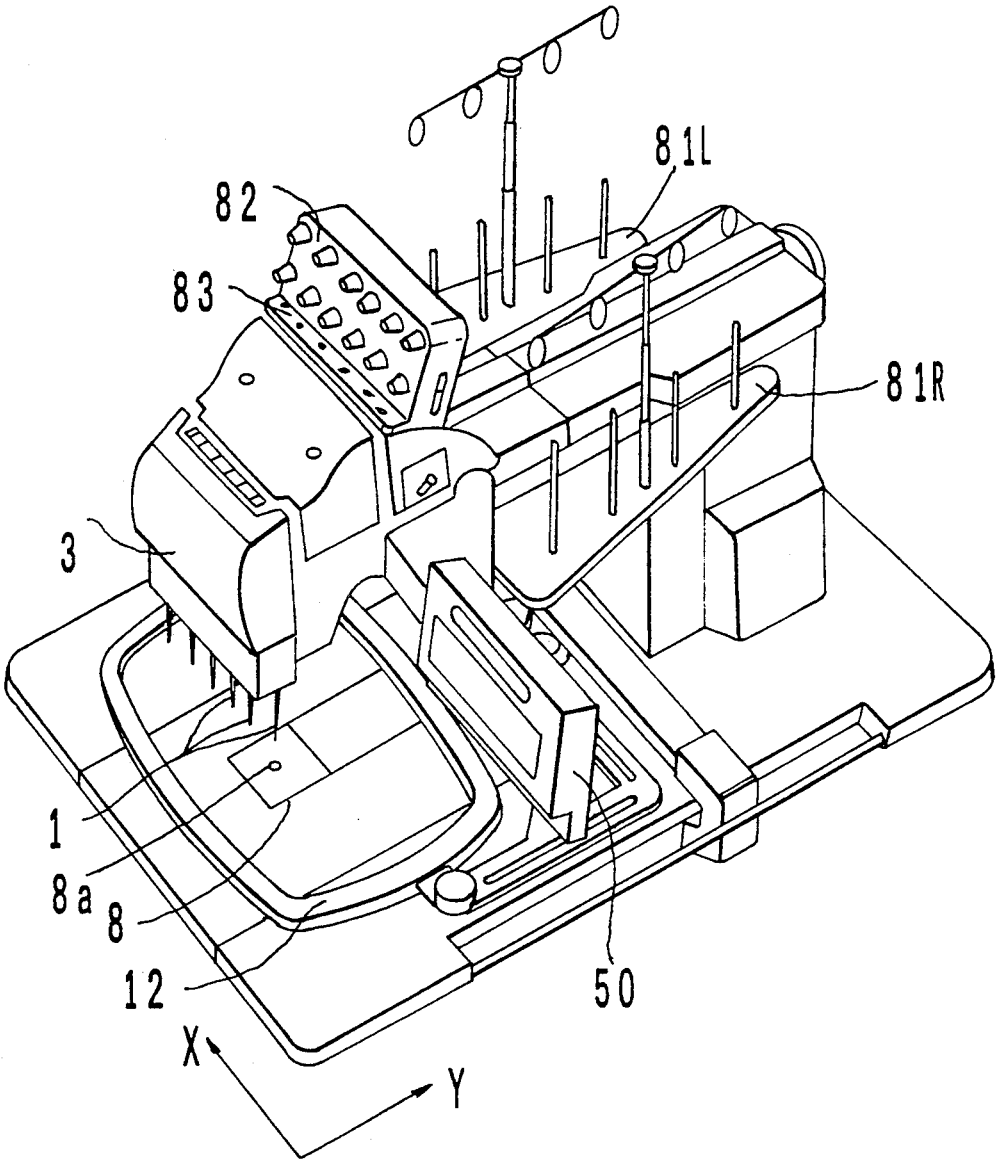
FIG. 1 is a perspective view showing the appearance of an embroidery machine according to an embodiment.

The appearance of an overall embroidery machine according to an embodiment is shown in FIG. 1. The embroidery machine is provided with six sewing needles 1, one of which is selected by a needle selector, which is known in the art, and is positioned directly above a needle hole 8*a* formed in a throat plate 8 before it is driven for elevating motion to perform a sewing operation. An embroidery frame 12 which is formed so as to surround the needle hole 8*a* is driven in the directions of X- and Y-axes in a horizontal plane when the sewing needle 1 is located about it in order to bring a next desired stitch position of a fabric supported thereby to the position of the needle hole 8*a*. In actuality, a mechanism associated with a pressure foot is disposed above the needle hole 8*a*, but is omitted from illustration in FIG. 1 for ease of illustration of other parts.

A pair of bobbin bases 81L and 81R, on which thread bobbins are placed, are mounted on a machine arm on the both sides thereof. Four bobbins may be normally mounted on each of the bobbin bases 81L and 81R. Each of threads which are taken out of six bobbins out of a total of eight bobbins is passed through a thread tension regulator 82, through an opening in a guide plate and through an opening in a thread take-up lever to be engaged with each of the sewing needles 1.

Figure 2:
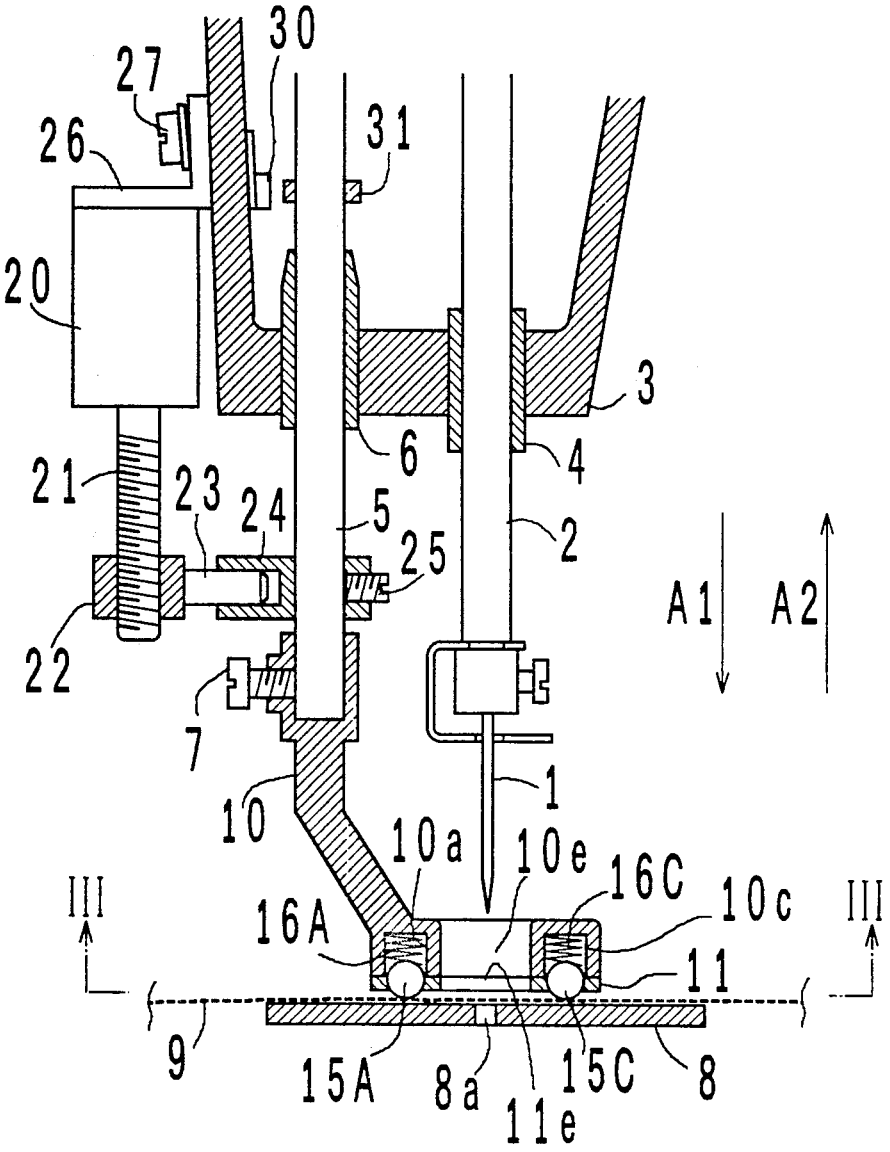
FIG. 2 is a cross section, to an enlarged scale, of a portion of the machine around a needle shown in FIG. 1.
Figure 3:
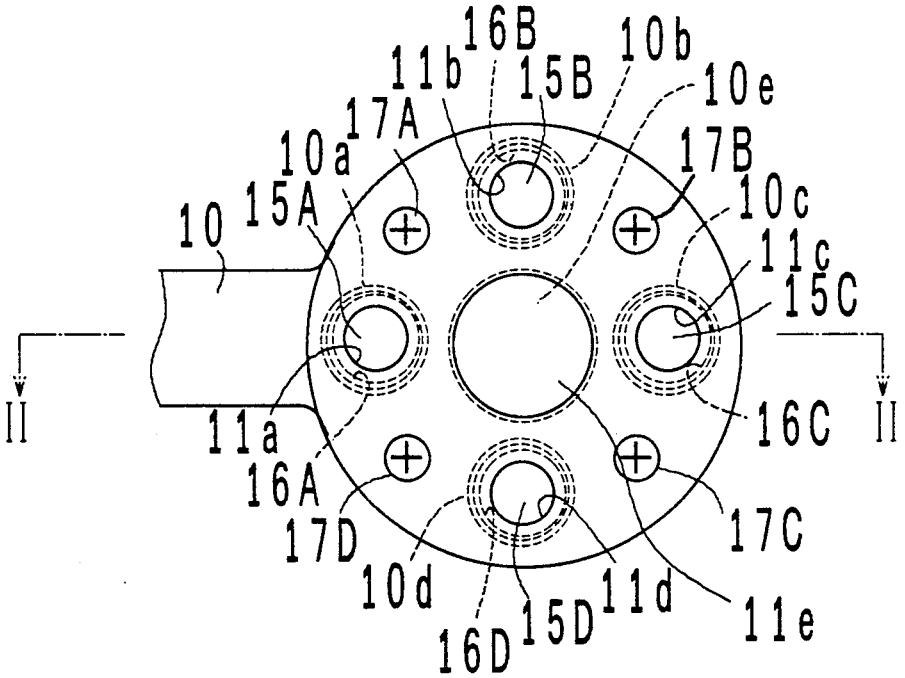
FIG. 3 is an enlarged bottom view as viewed in the direction of the line III—III shown in FIG. 2.

A specific construction around the needle 1 which is selected and which is positioned directly above the needle hole 8*a* is shown in FIG. 2*a* and a view as viewed from the line III—III shown in FIG. 2 is shown to an enlarged scale in FIG. 3. Referring to FIGS. 2 and 3, a needle bar 2 carrying the needle 1 is supported by a frame 3 through a bearing 4 interposed therebetween, and is connected to an upper shaft (not shown) which rotates as driven by a motor of the sewing machine, thus repeating its elevating motion in synchronism with the rotation of the upper shaft. A push bar 5 disposed substantially parallel to the needle bar 2 is supported by the frame 3 through a bearing 6 interposed therebetween, and is vertically movable. A pressure foot 10 is coupled to the lower end of the push bar 5 and is secured thereto by a screw 7.

The pressure foot 10 comprises an arm portion which is coupled to the push bar 5, and a lower retainer foot 10*e* which is in the form of a ring. The retainer foot 10*e* is formed with four circular openings 10*a*, 10*b*, 10*c*, 10*d* in its lower surface, into which coiled compression springs 16A, 16B, 16C and 16D are inserted, with spheres 15A, 15B, 15C and 15D disposed therebelow. To prevent the compression springs 16A–16D and the spheres 15A–15D from being disengaged from the four openings 10*a*, 10*b*, 10*c* and 10*d*, the lower surface of the retainer foot 10*e* is covered by a circular plate 11, which is secured thereto by screws 17A, 17B, 17C and 17D. The plate 11 is formed with openings 11*a*, 11*b*, 11*c* and 11*d* in alignment with the spheres 15A, 15B, 15C and 15D, respectively, each having a diameter slightly less than the diameter of these spheres so that part of the spheres 15A to 15D is exposed through these openings 11*a* to 11*d* and projecting below the lower surface thereof. A needle opening 11*e* is formed centrally in the plate 11.

An electric motor 20, which is a stepping motor in the example shown, for vertically driving the push bar 5 is secured to the frame 3 by a fixture 26 and a screw 27. The motor 20 has a drive shaft on which a screw 21 is mounted and is in meshing engagement with a nut 22. The nut 22 is fixedly mounted on a stud 23 which is engaged with a follower 24. The follower 24 is fixedly mounted on the push bar 5 by means of a screw 25. Accordingly, as the motor 20 is driven, the screw 21 rotates to move the nut 22 in the vertical direction, thereby moving its connected push bar 5 and the pressure foot 10 in the vertical direction.

Figure 7:
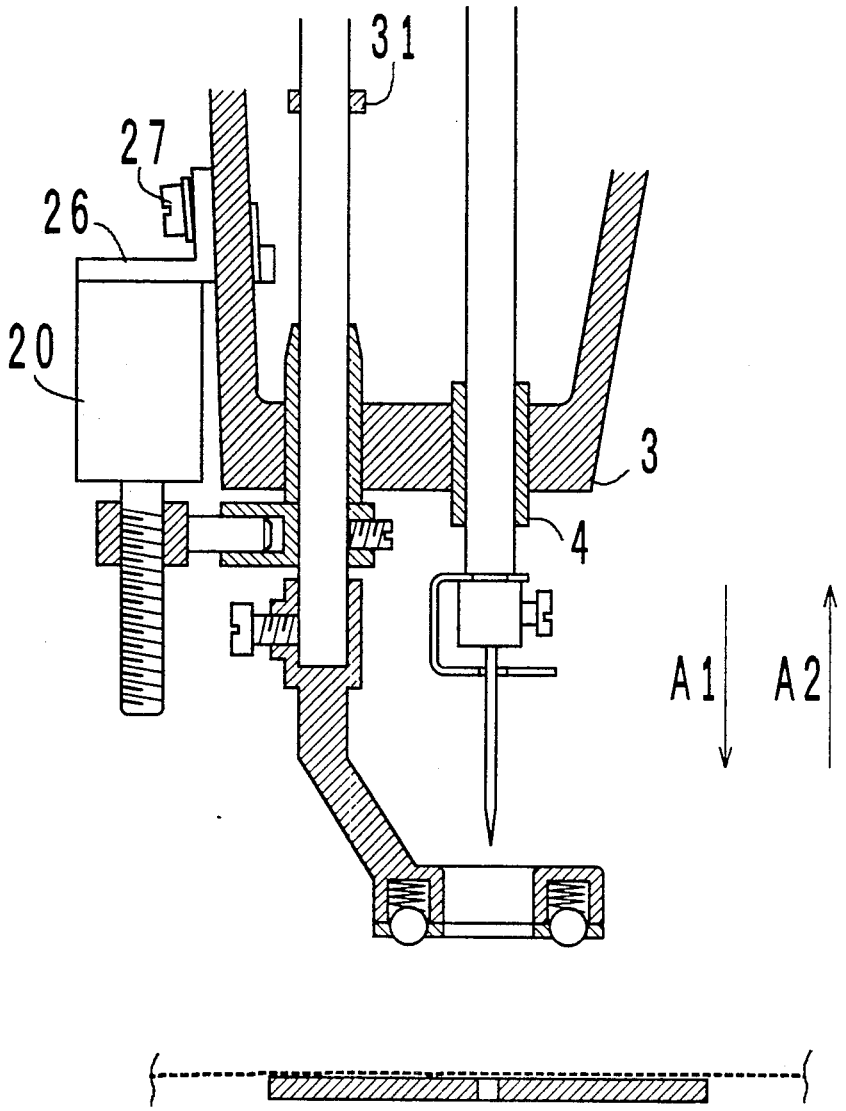
FIG. 7 is a cross section of parts located around the needle shown in FIG. 1 when it assumes a retracted position.

When the pressure foot 10 is moved down to its pressed position (P1) shown in FIG. 2, a fabric 9 which is placed on the throat plate 8 is urged downward by the compression springs 16A–16D acting through the spheres 15A–15D, and accordingly the fabric 9 can be held against lifting by the force which is produced when the needle 1 is inserted into and withdrawn from the fabric 9. However, under such condition, the spheres 15A–15D can be rotated with a relatively small force applied thereto, and hence can be moved in the directions of X- and Y-axes as the embroidery frame 12 is driven. In other words, there is no need to move the pressure foot 10 up and down as the needle 1 undergoes an elevating motion. However, before the commencement and at the completion of a sewing operation, the pressure foot 10 is raised to its retracted position (P2) shown in FIG. 7 in order to engage and disengage the fabric and the embroidery frame 12.

In order to detect a home position of the push bar 5, a colored annular positioning member 31 is fixedly mounted on an upper portion of the push bar, and an optical sensor of reflection type, acting as a home position sensor 30, is mounted on the frame 3 at a position where it can be disposed opposite to the positioning member 31. Specifically, when the pressure foot 10 is at its lower limit position shown in FIG. 2, the sensor 30 detects the presence of the positioning member 31, and determines this as the detection of the home position. Otherwise, the sensor assumes a non-detection condition. The position of the push bar 5 is detected in terms of a travel from this home position, and the travel is determined on the basis of the number of drive steps of the motor 20.

Figure 4:
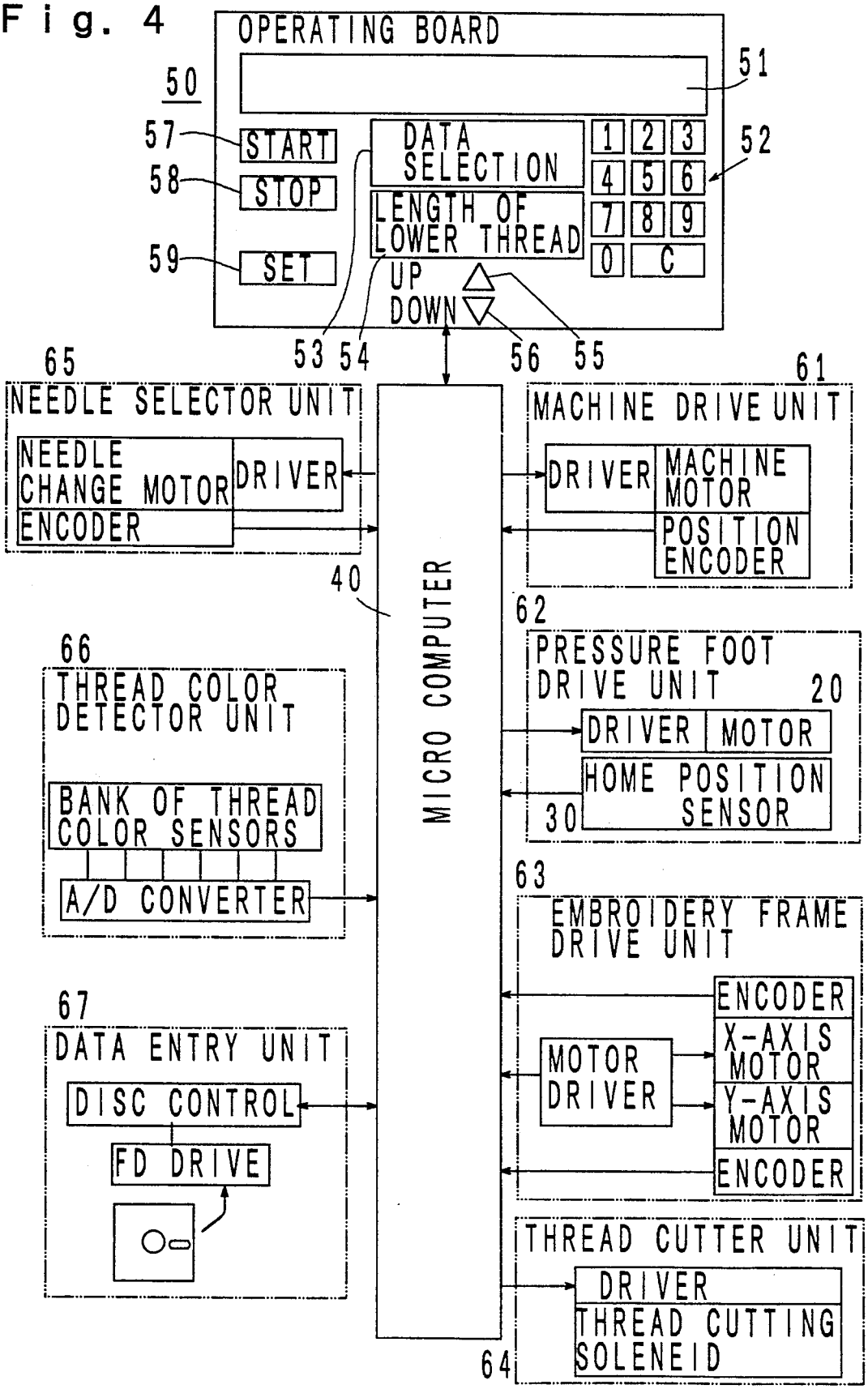
FIG. 4 is a block diagram of an electrical arrangement of the embroidery machine.

An electric arrangement of the embroidery machine shown in FIG. 1 is illustrated in FIG. 4. Referring to FIG. 4, a microcomputer 40 is provided for controlling the entire embroidery machine in this example. An operating board 60, a machine drive unit 61, a pressure foot drive unit 62, an embroidery frame drive unit 63, a thread cutter unit 64, a needle selector unit 65, a thread color detector unit 66 and data entry unit 67 are connected to the microcomputer 40. The machine drive unit 61, the embroidery frame drive unit 63, the thread cutter unit 64, the needle selector unit 65, the thread color detector unit 66 and the data entry unit 67 are similarly constructed as conventional ones. The pressure foot drive unit 62 includes the motor 20, its associated driver and the home position sensor 30.

The operating board 50 contains a display 51 capable of displaying various information items and a variety of key switches. The key switches include numerical keys 52, data selection key 53, pressure foot position key 54, UP key 55, DOWN key 56, start key 57, stop key 58, and set key 59. Data selection key 53 is used when selecting one of a plurality of embroidery date items stored on a flexible magnetic disc which is loaded into the data entry unit 67. The pressure foot position key 54 is used for adjustment of the pressed position (P1) and the retracted position (P2) of the pressure foot 10 by a user.

Figure 5:
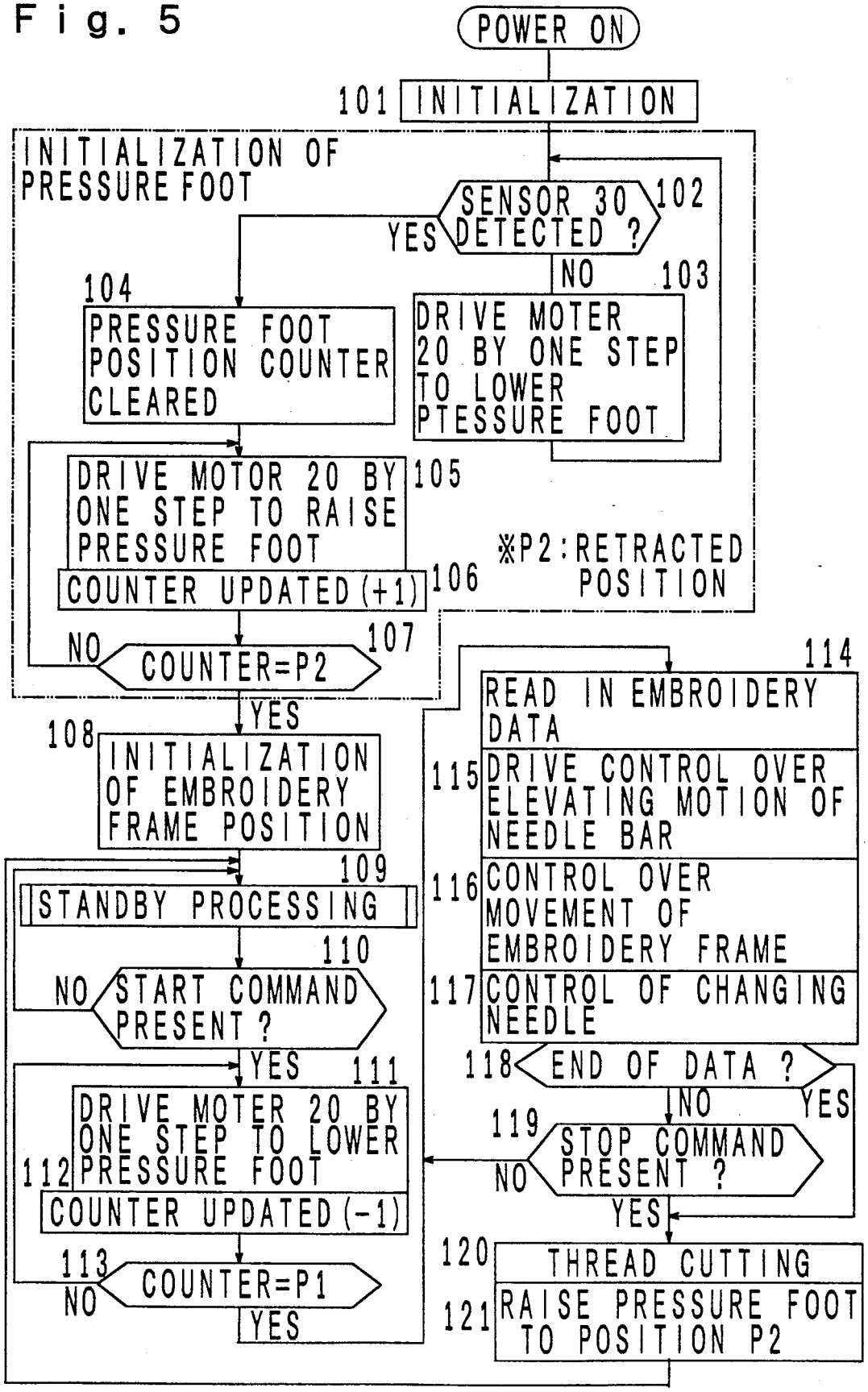
FIG. 5 is a flow chart for a microcomputer shown in FIG. 4.
Figure 6:
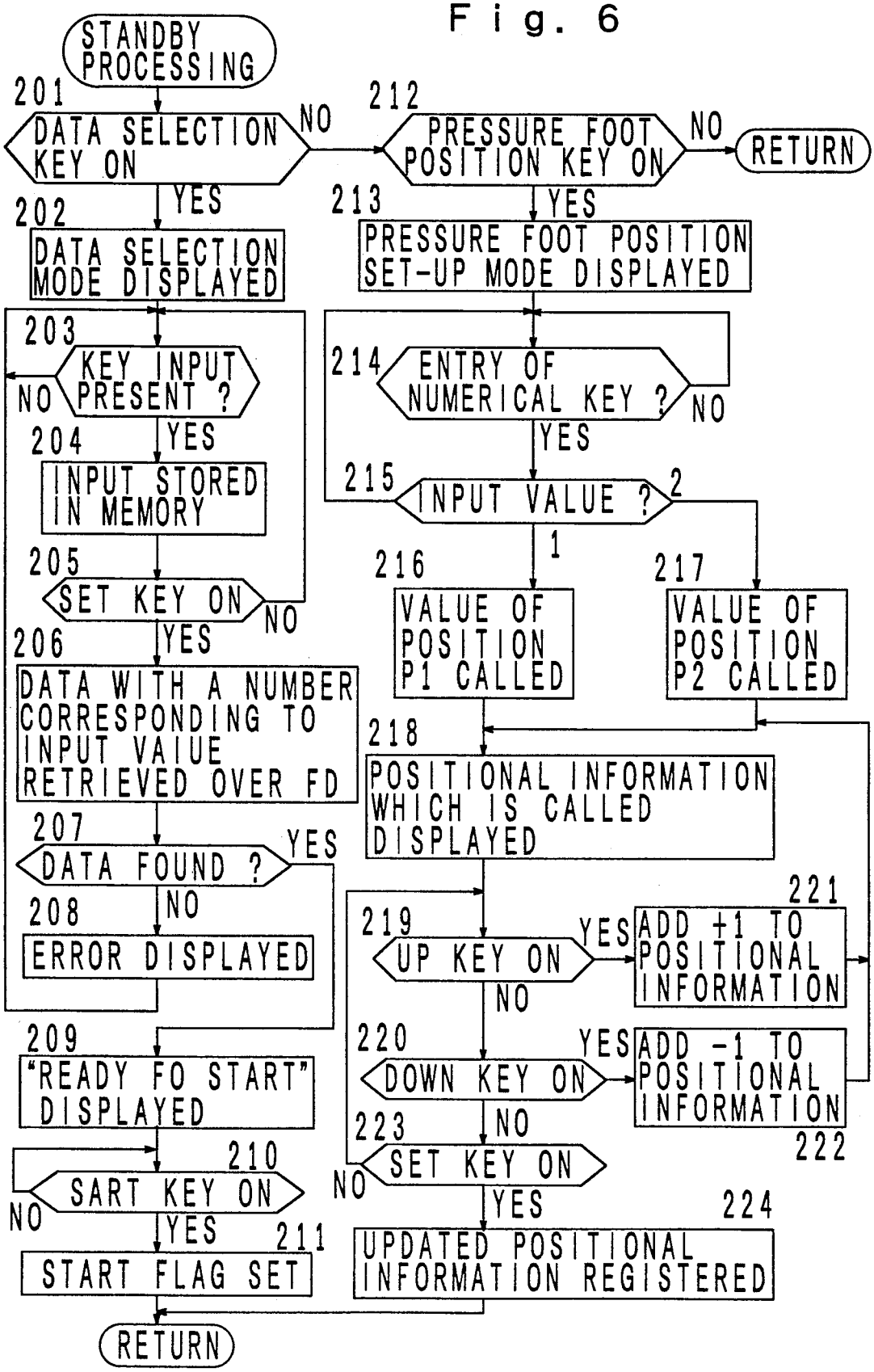
FIG. 6 is a flow chart of a standby processing shown in FIG. 5.

The operation of the microcomputer 40 shown in FIG. 4 is illustrated by a flow chart shown in FIG. 5, and the detail of a standby processing subroutine of FIG. 5 (shown at step 109) is illustrated in FIG. 6. Initially referring to FIG. 5, the overall operation of the embroidery machine will be described. Upon turning on the power supply, an initialization is executed. Specifically, internal memories within the microcomputer 40 itself are initialized, various modes are established and given interrupts are set up, thus bringing the various units connected to the microcomputer 40 to predetermined initial conditions. Then "initialization of pressure foot position" routine is executed, followed by the execution of "initialization of embroidery frame position" routine.

In the "initialization of pressure foot position" routine, while the home position sensor 30 is not detecting a home position at step 102, the motor 20 is driven one step at step 103 to move the pressure foot 10 down. When the pressure foot 10 is moved down to the lower limit position shown in FIG. 2, the sensor 30 detects the home position, whereupon the program proceeds from step 102 to step 104 where the pressure foot 10 is positioned. Under the initial condition, the lower limit position (or home position) is chosen to be the pressed position (P1). At step 104, the content of a pressure foot position counter which is assigned to an internal memory is cleared. The pressure foot position counter is utilized to detect a travel from the home position. At next step 105, the motor 20 is driven one step to raise the pressure foot 10, followed by step 106 where "+1" is added to the content of the pressure foot position counter. At step 107, the content of the pressure foot position counter is examined to see if it matches the value of the retracted position P2. If it does not match, the program returns to step 105, and then the steps 105 and 106 are repeated. This operation is effective to position the pressure foot 10 at its retracted position (P2) shown in FIG. 7.

Subsequent to the initialization of the embroidery frame position indicated at step 108, a standby processing routine indicated by step 109 follows. This routine is repeatedly run until a start command is detected at step 110. Upon detection of the start command, the motor 20 is driven one step at step 111 to move the pressure foot 10 down, and at next step 112, "−1" is added to the content of the pressure foot position counter. At following step 113, the content of the pressure foot position counter is examined to see if it matches the value of the pressed position P1. If no matching is found, the program loops back to step 111, then repeating the steps 111 and 112. If the matching is found, namely, if the pressure foot 10 is positioned at the pressed position P1 (which is equal to the condition shown in FIG. 2 under the initial condition), the program proceeds to step 114.

At step 114, selected embroidery data items are sequentially entered through the data entry unit 67, and the elevating drive of the needle bar 2 is controlled in accordance with such embroidery data at step 115. At step 116, the movement of the embroidery frame is controlled. At step 117, an exchange of the needle 1 is controlled. Such operation is repeatedly executed until the end of the embroidery data is detected at step 118 or until a stop command is detected at step 119. If the end of the embroidery data is detected at step 118 or the stop command is detected at step 119, a thread cutting is performed at step 120, followed by positioning the pressure foot to its retracted position P2 at following step 121.

Referring now to FIG. 6, "standby processing" subroutine will be described in detail. When the "data selection" key on the operating board 50 is depressed, the program proceeds from step 201 to step 202 where "data selection mode" is displayed on the display 51. At step 203, a key entry is waited for. When the numerical key 52 is depressed, a numerical value which corresponds to the operated key is stored in a memory at step 204, and when the "set" key is depressed, the data entry unit 67 is accessed for embroidery data having a number corresponding to the numerical value entered by the numerical key, and such data is retrieved. When embroidery data having a number corresponding to the entered value is not found, an error is displayed at step 208, whereupon the program loops back to step 203. If such data is found, "ready to start" is displayed at step 209, and step 210 waits for the depression of the "start" key. Upon depression of the "start" key, the start flag is set at step 211, whereupon the program returns to the main routine. The start flag is referred to at step 110 in FIG. 5, and if the flag is set, this is interpreted as the presence of the start command.

When the "pressure foot position" key is depressed on the operating board 50, the program proceeds from step 212 to step 213 where "pressure foot position set-up mode" is displayed on the display 51. Then step 214 waits for a key entry. If the numerical key 52 corresponding to "1" is now depressed, the program proceeds to step 216, and if "2" is depressed, the program proceeds to step 217. At step 216, the content of a read-write memory which stores positional information of the pressed position P1 is read out and is stored in a memory of a work area. Similarly, at step 217, the content of a read-write memory storing positional information of the retracted position P2 is read out, and is stored in a memory of a work area. At next following step 218, the positional information (either P1 or P2) stored in the memory of the work area is displayed on the display 51 and then the program waits for a key entry. Upon depression of UP key 55, "+1" is added to the value of the positional information stored in the memory of the work area, while upon depression of DOWN key 56, "−1" is added to the value of positional information stored in the memory of the work area. Upon depression of "set" key 59, the updated value of positional information stored in the memory of the work area is written into a read-write memory which is assigned to positional information of pressed position P1 or retracted position P2, thus updating and registering P1 or P2. Thus, by using the "pressure foot position set-up" mode, a user is allowed to adjust the pressed position P1 or the retracted position P2 as required in accordance with the thickness of the fabric, for example, through an instruction from the operating board 50. It is to be understood that an initial value which is previously stored in ROM is stored into the read-write memory assigned to positional information of the pressed position P1 or retracted position P2 during the initialization.

Another embodiment will now be described. This embodiment remains the same as the embodiment mentioned above except for a modification relating of the processing such as the positioning control, and accordingly, similar parts are designated by like reference characters without repeating their description. An embroidery machine which incorporates this embodiment has the same appearance as shown in FIG. 1, and has an electrical arrangement which remains the same as shown in FIG. 4 except that the operation performed by the microcomputer 40 is modified. The pressure foot mechanism remains the same as before. The operation of the microcomputer 40 according to this embodiment is illustrated in FIGS. 8 and 9, and will now be described with reference to these Figures.

Figure 8:
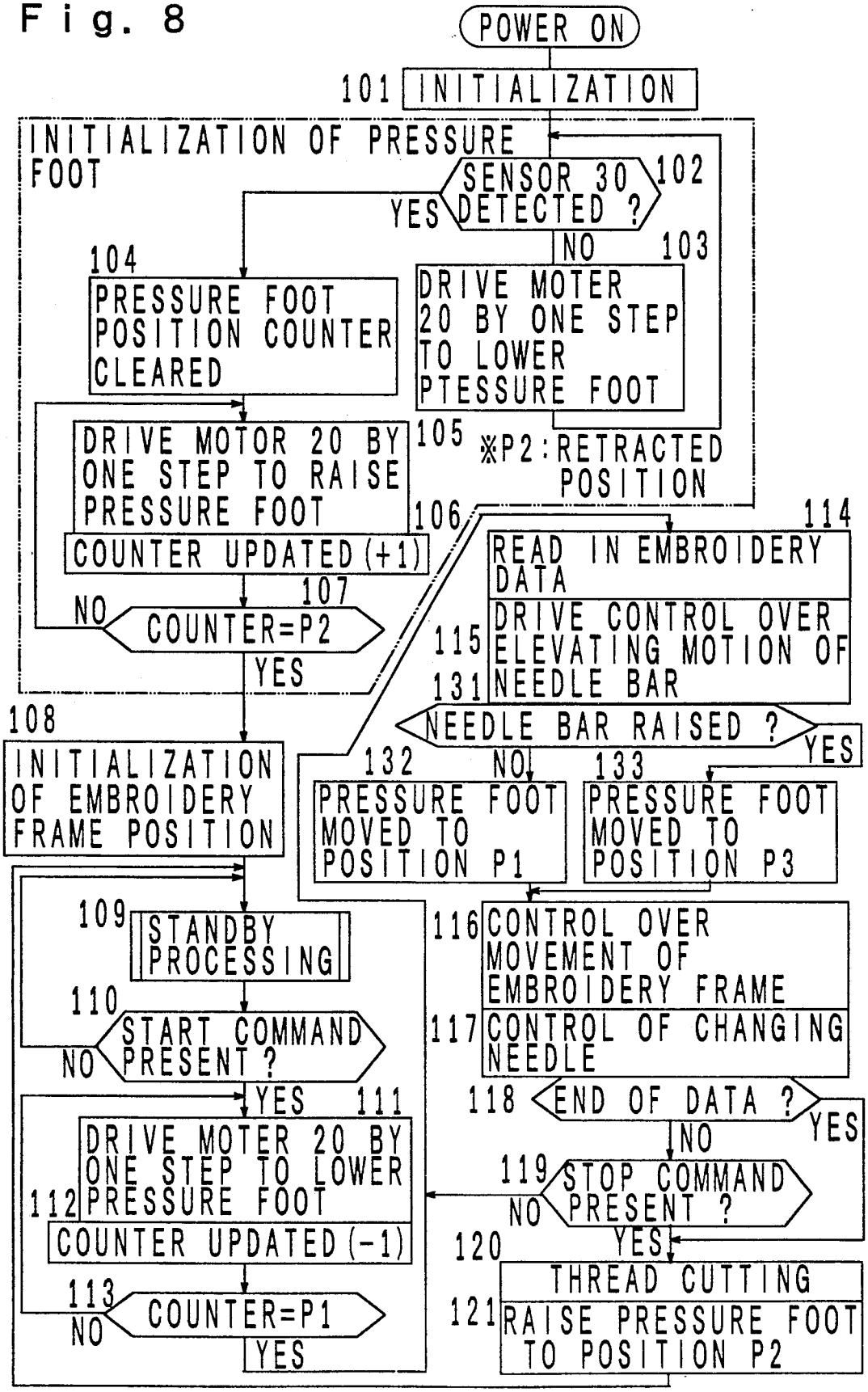
FIG. 8 is a flow chart illustrating the operation of another embodiment.
Figure 9:
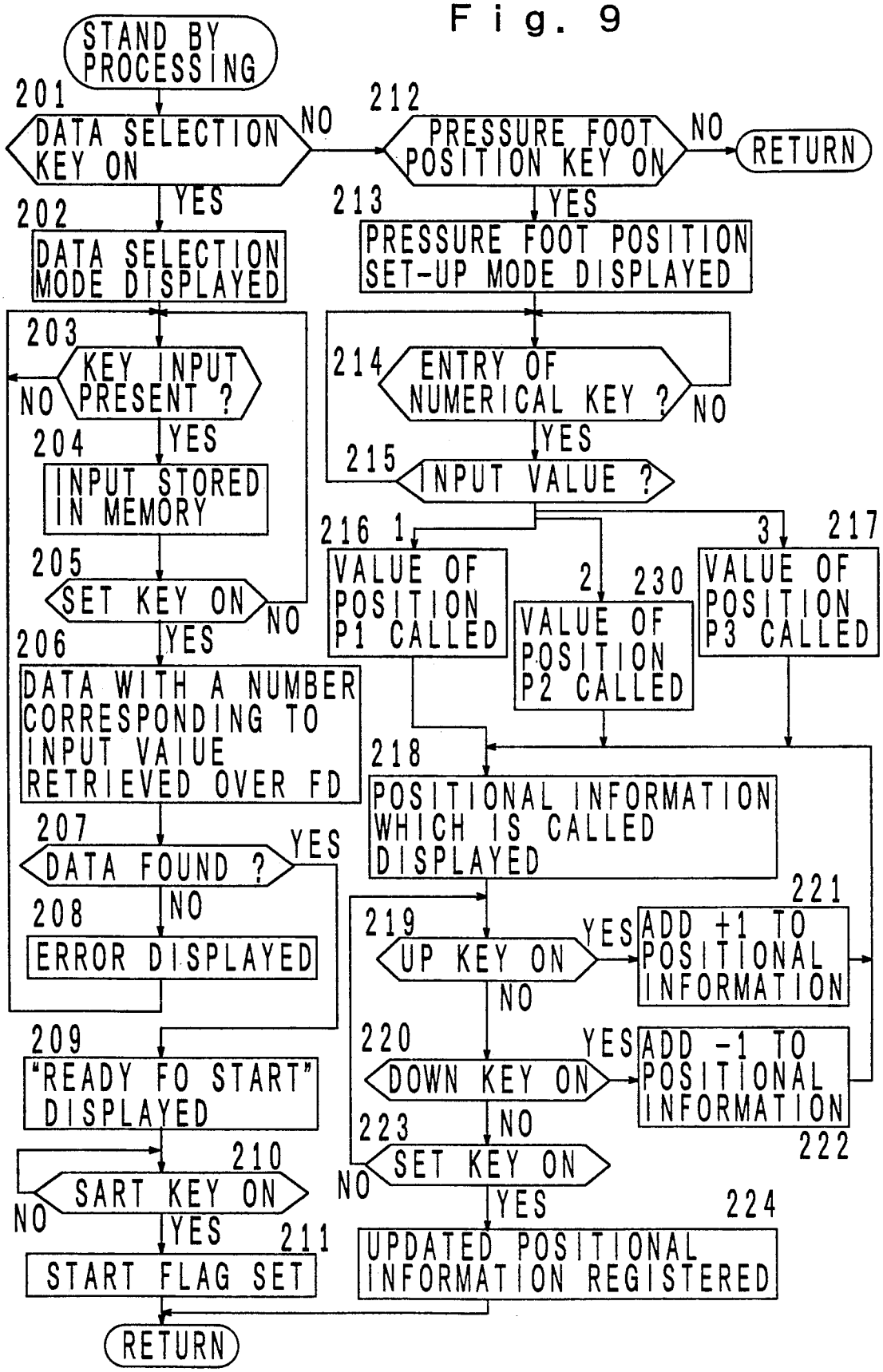
FIG. 9 is a flow chart of the standby processing for the embodiment shown in FIG. 8.

Initially referring to FIG. 8, the detail of "initialization of pressure foot position" remains the same as in the previous embodiment. When a start command is detected at step 110, the motor 20 is driven one step at step 111 to move the pressure foot 10 down. At next step 112, "−1" is added to the content of the pressure foot position counter, and step 113 examines if the content of the counter matches the value of the pressed position P1. If matching is not found, the program returns to step 111 and repeats the steps 111 and 112. When matching is found, or when the pressure foot 10 is positioned at the pressed position P1 (which is equal to the condition shown in FIG. 2 under the initial condition), the program then proceeds to step 114.

Figure 10:
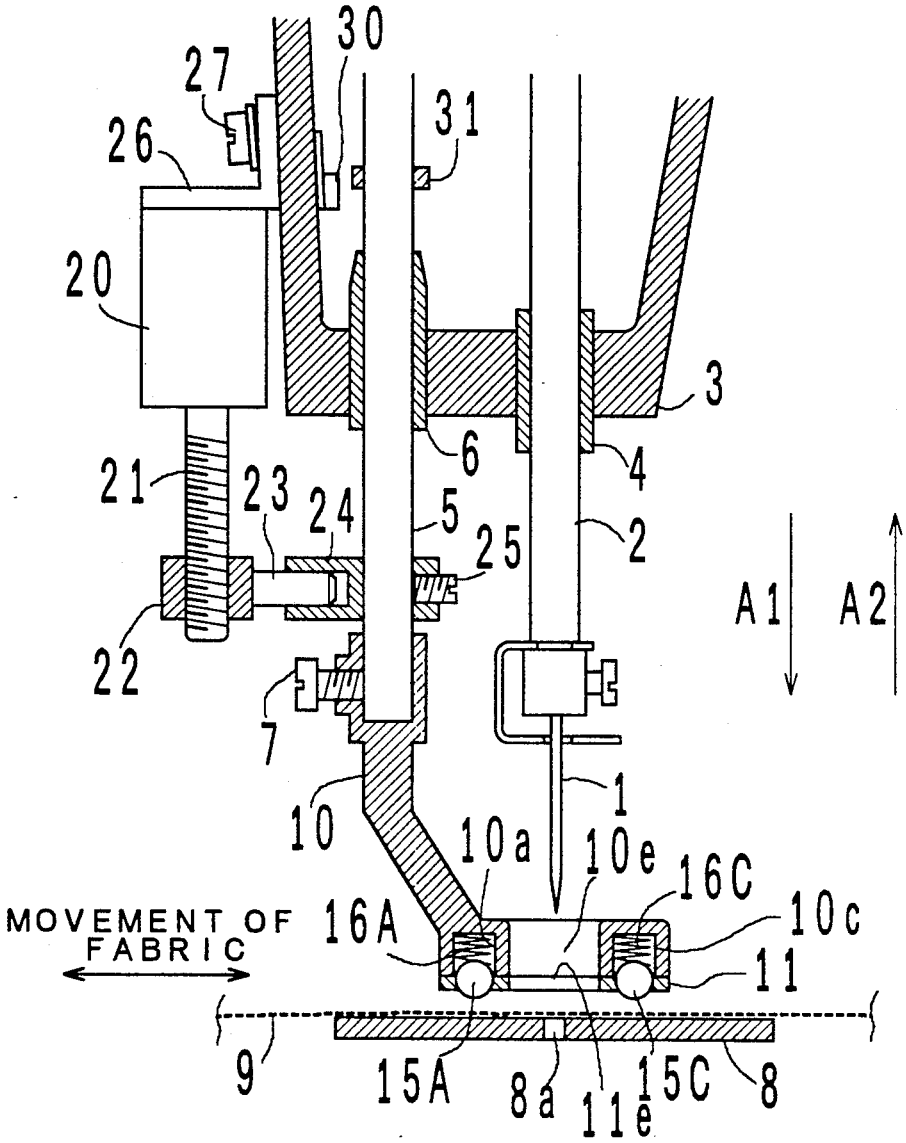
FIG. 10 is a cross section of parts located around the needle shown in FIG. 1 when it assumes a released position.

At step 114, selected embroidery data is sequentially entered through the data entry unit 67, and at step 115, the elevating motion of the needle bar 2 is controlled in accordance with such embroidery data. Step 116 controls the movement of the embroidery frame while the next following step 117 controls an exchange of the needle 1. When the needle bar 2 is not at its elevated position (where the needle 1 is not engaged with the fabric), the program proceeds from step 131 to step 133, moving the pressure foot to the released position P3 (the condition shown in FIG. 10). Thus, the motor 20 is driven to change the position of the pressure foot 10 until the content of the pressure foot position counter matches P1 (or P3).

Accordingly, in the present embodiment, the fabric is firmly retained in position by the pressure foot when the needle 1 engages and disengages from the fabric, thereby positively preventing a lifting or wandering of the fabric. When a movement of the embroidery frame is required to move the fabric, the pressure foot is slightly raised beforehand to release the pressing force, and hence the possibility that the pressure foot mechanism interferes with a movement of the fabric as the embroidery frame is moved is avoided. The stroke travelled by the pressure foot between the pressed position P1 and the released position P3 is only a slight distance corresponding to the order of the thickness of the fabric, and there is no need to move the pressure foot rapidly. Accordingly, the likelihood of producing sounds of high level as a result of a percussion or impact is prevented.

In the "standby processing" subroutine shown in FIG. 9, it is possible to adjust the released position P3, in the same manner as the positions P1 and P2 are adjusted, by entering "3" from the numerical key during the "pressure foot position set-up" mode. In other respects, the arrangement remains the same as shown in FIG. 6.

As discussed above, in accordance with the invention, there is no need to mechanically connect the pressure foot member with a needle elevating mechanism, but the pressure foot member may be driven and positioned by independent drive means. The pressure foot member internally houses a plurality of spherical means in a rotatable manner which are exposed through the lower surface of the member, and which are urged downward by an elastic member, so that the spherical members remain rotatable to permit a free movement of the fabric in the horizontal direction even when the spherical members presses against the fabric at the pressed position (P1) of the pressure foot member. Thus, during the operation of the sewing machine, the pressure foot member assumes the pressed position where it holds the fabric while allowing it to be movable in a horizontal direction, and hence there is no need to elevate the pressure foot member in accordance with the elevating motion of the needle, thus eliminating the likelihood of producing sounds of percussion or impact.

According to another embodiment of the invention, the positioning control means positions the pressure foot member at a first position (pressed position) during the elevating motion of the needle and during a movement of the fabric, and positions the pressure foot member at a second position (retracted position) higher than the first position in response to a given release command. Specifically, when the pressure foot member is at its first position, the fabric can be held against a vertical movement. When the given release command is applied, the pressure foot member is raised to its retracted position, facilitating the engagement or disengagement of the embroidery frame or fabric.

According to a further feature of the invention, the positioning control means positions the pressure foot member at a first position during the elevating motion of the needle, positions the pressure foot member at a third position higher than the first position during a movement of the fabric, and positions the pressure foot member at a second position higher than the third position in response to a given release command. Thus, when the pressure foot member is at its first position, the fabric can be held against movement. When the pressure foot member is at its third position where it is located by the order of the thickness of the fabric higher than the first position, the force which presses the fabric is released, permitting a free movement of the fabric in the horizontal direction. When the pressure foot member is at its third position, there is a very slight clearance between the lower surface of the pressure foot member and the fabric, which is insufficient to allow the engagement or disengagement of the embroidery frame, and which is also unsuitable to engaging or disengaging the fabric alone. However, by providing a given release command, the pressure foot member may be raised to its second position, where the engagement or disengagement of the embroidery frame or fabric can be easily implemented. During the operation of the sewing machine, the pressure foot member repeatedly moves back and forth between the first and the third position, and the fabric is allowed to move when it assumes the third position. Since the first and the third position are close to each other, the stroke travelled by the pressure foot member for its movement between these positions is reduced and hence need not be driven rapidly, preventing the occurrence of sounds of percussion or impact as it moves.

According to an additional feature of the invention, each of the first, the second and the third position may be adjusted by utilizing position presetting means. Thus, the first position may be adjusted to provide an optimum pressing force in accordance with the thickness of the fabric. The second position may be adjusted in accordance with the thickness of the fabric so as to release the pressing force positively while minimizing the stroke travelled by the pressure foot member. The third position may be adjusted in accordance with the height of the embroidery frame so as to facilitate its engagement and disengagement.

What is claimed is:

1. A pressure foot unit for a sewing machine comprising:

a pressure foot member supported by a body of the sewing machine in an elevatable manner and located adjacent to a sewing needle;

a plurality of spherical means rotatably mounted at different positions within the pressure foot member, each partly exposed through the lower surface of the pressure foot member;

an elastic member mounted on the pressure foot member for urging each spherical member downward;

drive means for driving the pressure foot member for an elevating motion;

reference position detecting means for detecting that the pressure foot member is located at a given position; and positioning control means for energizing the drive means to position the pressure foot member as referenced to a position detected by the detecting means, to position the pressure foot member at a first position during an elevating motion of the needle and a movement of a fabric, and to position the pressure foot member at a second position higher than the first position in response to a given release command.

2. A pressure foot unit for a sewing machine comprising:

a pressure foot member supported by a body of the sewing machine in an elevatable manner and located adjacent to a sewing needle;

a plurality of spherical means rotatably mounted at different positions within the pressure foot member, each partly exposed through the lower surface of the pressure foot member;

an elastic member mounted on the pressure foot member for urging each spherical member downward;

drive means for driving the pressure foot member for elevating motion;

reference position detecting means for detecting that the pressure foot member is located at a given position; and positioning control means for energizing the drive means to position the pressure foot member as referenced to a position detected by the detecting means, to position the pressure foot member at a first position during an elevating motion of the needle, to position the pressure foot member at a third position which is substantially by the order of thickness of a fabric higher than the first position during a movement of the fabric, and to position the pressure foot member at a second position higher than the third position in response to a given release command.

3. A pressure foot unit according to claim 2, in which the positioning control means includes position presetting means for adjusting the first, the second and the third position.

* * * * *